US007814711B2

(12) United States Patent
Milligan et al.

(10) Patent No.: US 7,814,711 B2
(45) Date of Patent: Oct. 19, 2010

(54) INTERIOR WALL SYSTEM

(75) Inventors: Geoffrey Milligan, Toronto (CA); Zoran Baic, Mississauga (CA); Paul Kruger, Toronto (CA)

(73) Assignee: TK Canada Limited, Toronto (CA)

( * ) Notice: Subject to any disclaimer, the term of this patent is extended or adjusted under 35 U.S.C. 154(b) by 721 days.

(21) Appl. No.: 11/806,099

(22) Filed: May 30, 2007

(65) Prior Publication Data

US 2008/0295426 A1 Dec. 4, 2008

(51) Int. Cl.
*A47F 10/00* (2006.01)

(52) U.S. Cl. ..... 52/126.4; 52/36.1; 52/36.4; 52/220.1

(58) Field of Classification Search ..... 52/126.4, 52/36.1, 36.4, 220.1, 220.7, 238.1, 122.1
See application file for complete search history.

(56) References Cited

U.S. PATENT DOCUMENTS 4,881,353 A * 11/1989 Braendel et al. ..... 52/239
5,159,793 A * 11/1992 Deugo et al. ..... 52/126.1
6,058,665 A * 5/2000 Halvorson et al. ..... 52/205
6,446,396 B1 9/2002 Marangoni et al.
6,712,433 B2 * 3/2004 Hellwig et al. ..... 312/223.6
6,883,277 B2 * 4/2005 Wiechecki et al. ..... 52/36.6
7,454,867 B2 * 11/2008 Nicoletti ..... 52/238.1
7,571,578 B2 * 8/2009 Moody et al. ..... 52/481.1

FOREIGN PATENT DOCUMENTS

CA 2445129 10/2005

* cited by examiner

*Primary Examiner*—Richard E Chilcot, Jr.
*Assistant Examiner*—Mark R Wendell
(74) *Attorney, Agent, or Firm*—Bereskin & Parr LLP/S.E.N.C.R.L., s.r.l.

(57) ABSTRACT

A leveling assembly for an interior wall system is disclosed. The wall system is composed of a number of wall panels configured for installation in a building having a ceiling and a floor. The assembly includes at least one elongate floor channel secured to the floor and a floor rail longitudinally disposed within the floor channel. The floor rail supports one or more of the wall panels. A number of levelers are positioned along the floor channel. The levelers permit the floor rail to be vertically spaced apart from the floor channel. The levelers are adjustable to level the floor rail in relation to the floor.

20 Claims, 11 Drawing Sheets

INTERIOR WALL SYSTEM

FIELD OF THE INVENTION

The invention relates generally to interior wall systems for buildings.

BACKGROUND OF THE INVENTION

Interior wall systems are well known. Such systems are commonly used, for example, to finish the open areas in office buildings. One type of interior wall system is a modular partition wall system which is composed of a number of wall panels in a side-by-side arrangement.

The above interior wall systems constructed using glass wall panels (whether transparent, translucent, or opaque) have become increasingly popular due to their aesthetic qualities. Such wall systems are commonly referred to as "glass walls". The present invention provides improvements in the wall system of this type.

SUMMARY OF THE INVENTION

According to one aspect of the present invention, a leveling assembly for an interior wall system is provided. The wall system is composed of a plurality of wall panels configured for installation in a building having a ceiling and a floor. The assembly comprises:

a) at least one elongate floor channel operatively secured to the floor;

b) a floor rail longitudinally disposed within the at least one floor channel, wherein the floor rail is adapted to support at least one of the plurality of wall panels; and c) a plurality of levelers positioned along the at least one floor channel, wherein the plurality of levelers are adapted to vertically space apart the floor rail from the at least one floor channel, wherein the plurality of levelers are adapted to substantially level the floor rail in relation to the floor.

DETAILED DESCRIPTION OF THE INVENTION

Figure 1:
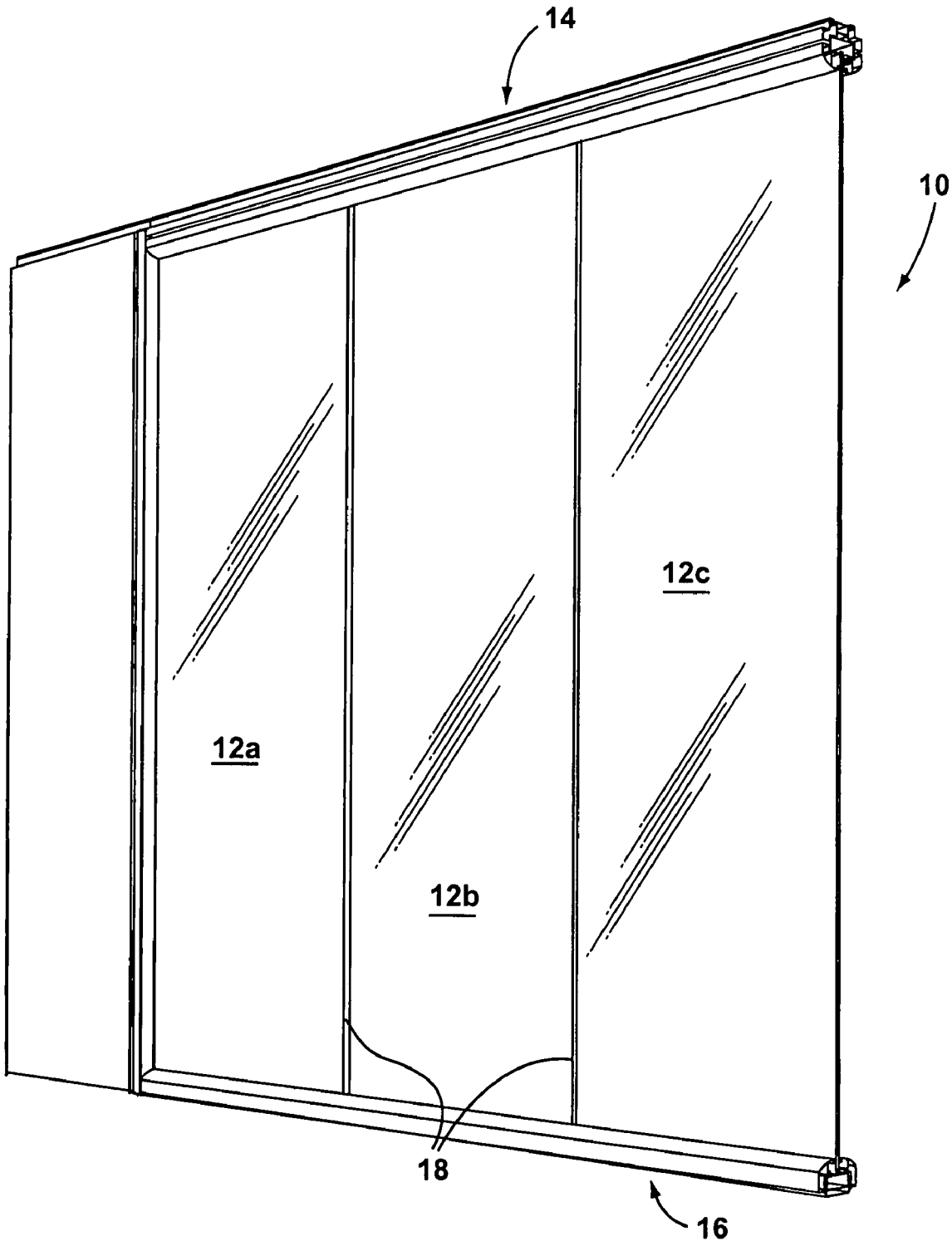
FIG. 1 is a perspective view of a glass wall system according to a preferred embodiment of the present invention.

FIG. 1 shows an interior wall system 10 according to a first embodiment of the present invention. The interior wall system 10 illustrated in FIG. 1 includes three glass wall panels 12*a*, 12*b*, 12*c*. The upper edge of each glass wall panel is preferably secured within a ceiling retaining assembly 14 and the lower edge of each glass wall panel is secured within a floor leveling assembly 16. The glass wall panels are joined to each other at their vertical edges preferably by a transparent adhesive material 18, such as transparent silicone double-sided tape commercially available from 3M Corporation.

It will be understood by those skilled in the art that it is not essential that the wall panels be made of glass. The wall panels may be made from any other suitable material, whether transparent, translucent, or opaque.

Figure 2:
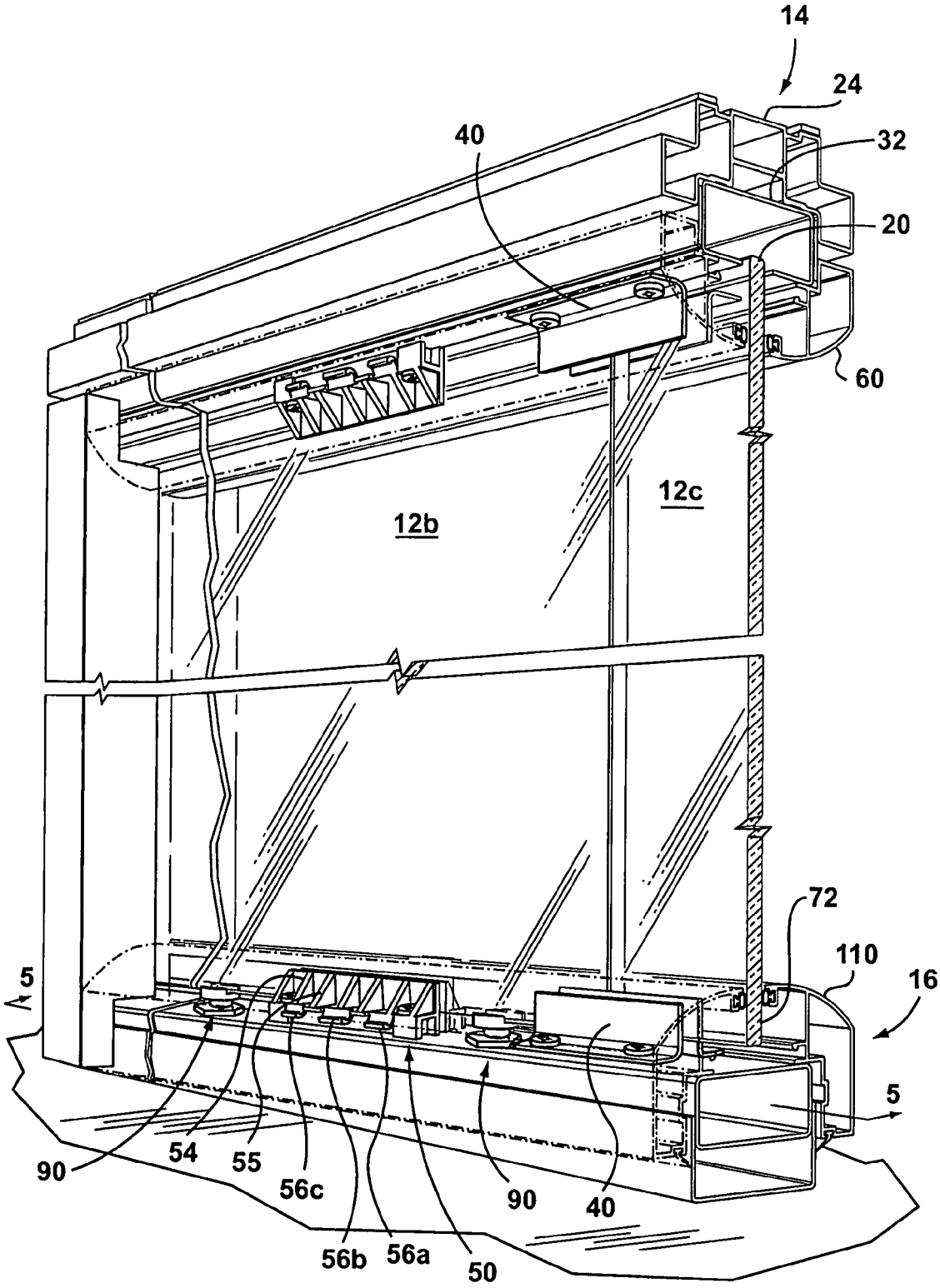
FIG. 2 is a partial perspective view of the preferred embodiment showing the ceiling retaining assembly and the floor leveling assembly.

Referring to FIG. 2, the wall panels (for clarity, only panels 12*b* and 12*c* are shown in FIG. 2) are secured at their upper edges 20 to a ceiling retaining assembly 14.

Figure 4:
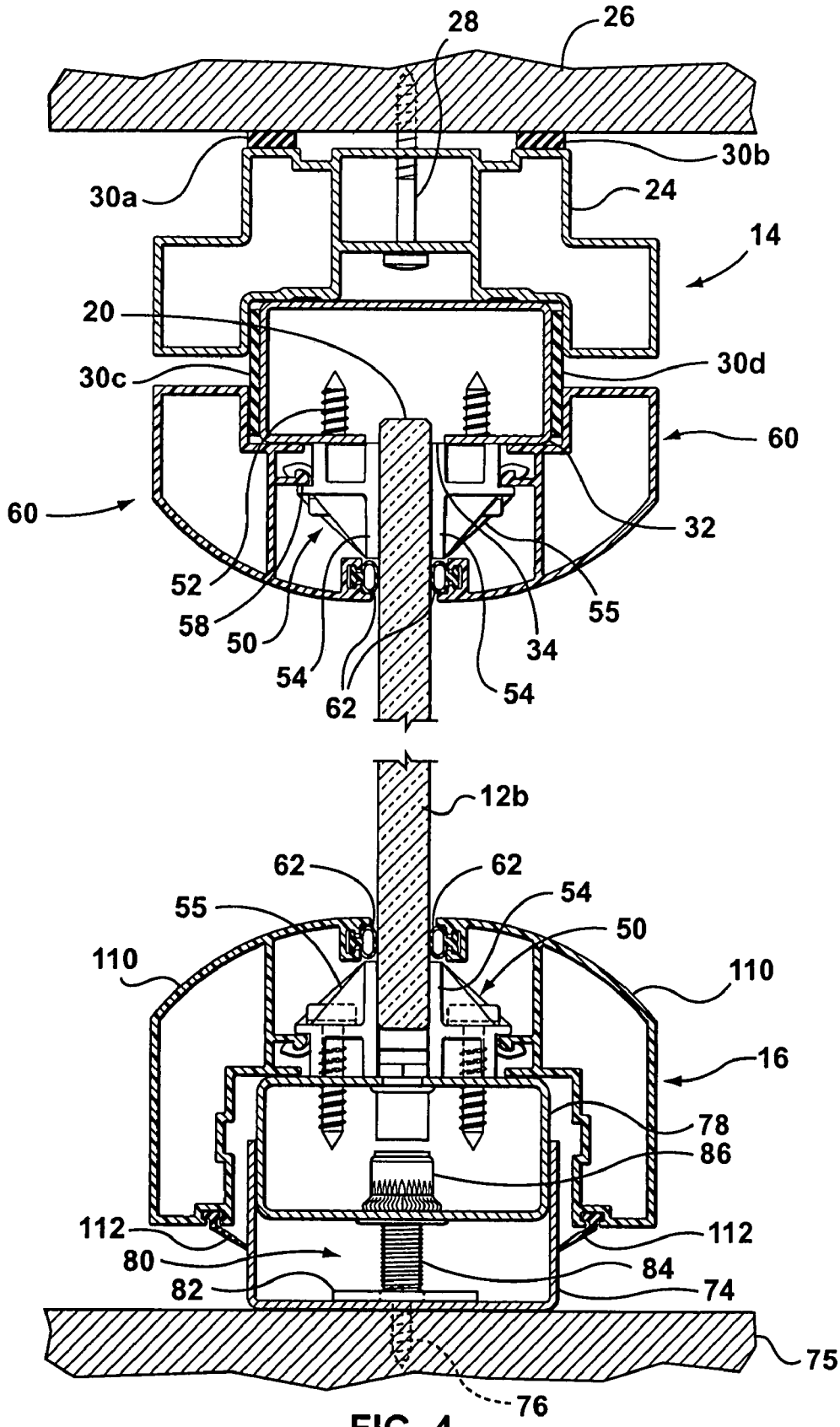
FIG. 4 is a cross-sectional view of the ceiling retaining assembly and the floor leveling assembly along line 4-4 of FIG. 3.

Referring now to FIGS. 2 and 4, the ceiling retaining assembly 14 includes a ceiling channel 24 secured to the ceiling 26 at any suitable interval by a fastener 28. The type of fastener used depends on the type of ceiling 26. Ceiling gaskets 30*a*, 30*b* may be provided between the ceiling channel 24 and ceiling 26 for improved sound attenuation. For longer runs, several ceiling channels 24 may be connected in series.

Continuing to refer to FIGS. 2 and 4, a ceiling rail 32 is received within the ceiling channel 24. Ceiling rail 32 is secured to ceiling channel 24 also by fasteners (not shown) at any suitable interval (which is offset from the fasteners 28) for securing the ceiling channel 24 to ceiling 26. Additional ceiling gaskets 30*c*, 30*d* may be positioned between the ceiling channel 24 and the ceiling rail 32. Preferably, the ceiling gaskets 30*a-d* are made of foam or any other suitable sound absorbing material.

A slot 34 is provided in the ceiling rail 32 to receive the upper edge 20 of the panels 12*a-c* (only panel 12*b* is shown in FIG. 4).

Referring now to FIGS. 2, 3, 4, and 7, elbow brackets 40 are located at the joints of adjacent glass panels, such as the joint between panels 12*b* and 12*c*. Preferably, a pair of elbow brackets 40 are positioned facing each other at each joint. Each elbow bracket 40 includes a vertical portion 42 which abuts against the panels 12*b*, 12*c* and a horizontal portion 44 which is secured by fasteners 46 to the ceiling rail 32. The elbow brackets 40 assist with retaining the panels in the slot 34 and stabilizing the panels.

Figure 3:
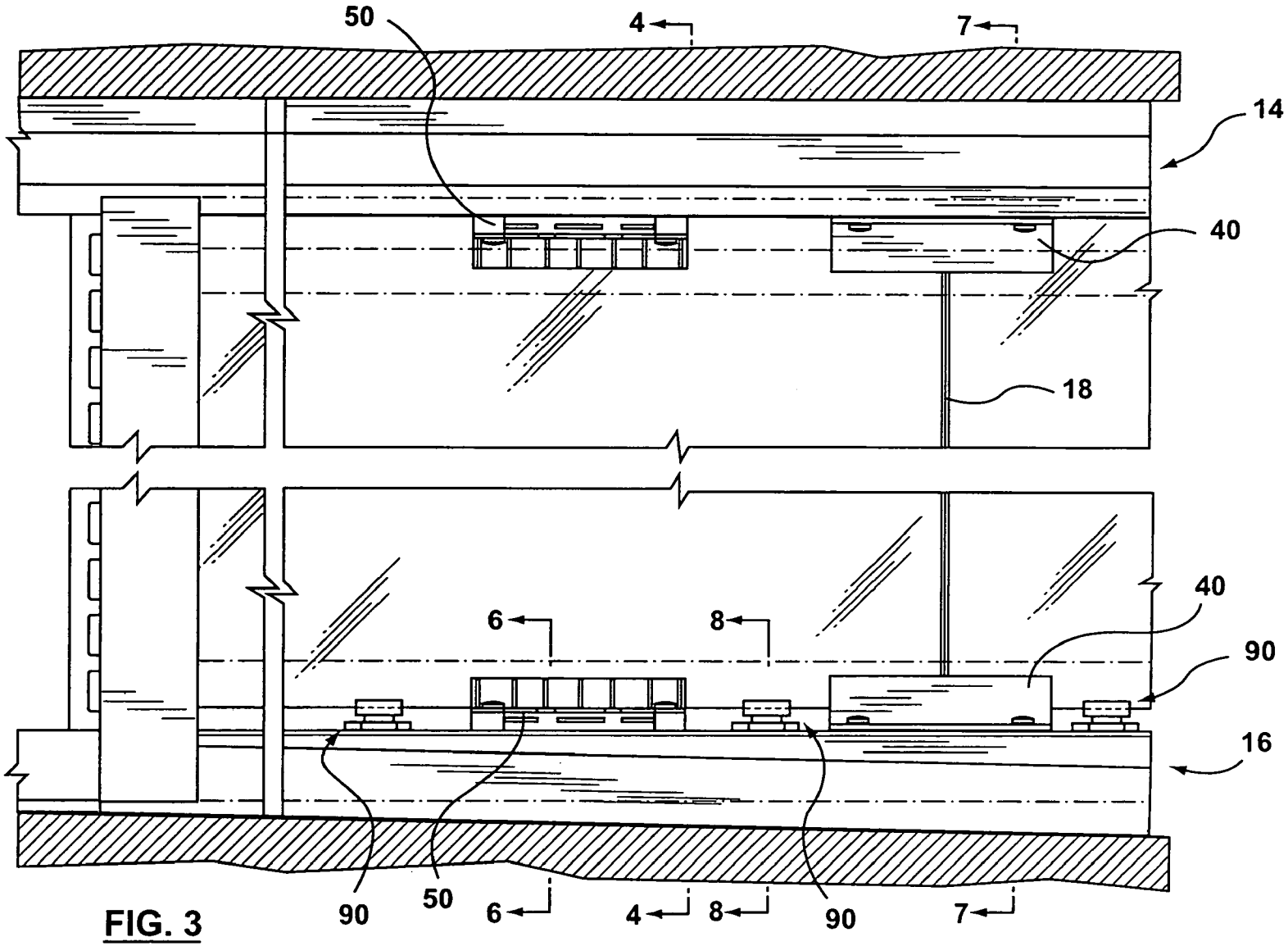
FIG. 3 is a partial elevation view of the preferred embodiment.

Referring now to FIGS. 2-4, clips 50 are also connected to the ceiling rail 32 by fasteners 52 at predetermined intervals. Preferably, the clips 50 are also positioned in facing pairs. Each of the clips 50 includes a vertical portion 54 to assist with retaining and stabilizing the panels 12*b*, 12*c*. Ribs 55 are preferably provided to add rigidity to the vertical portion 54 of the clips 50. Each of the clips include flexible lips 56*a-c* into which snaps a flexible ridge 58 of a ceiling trim member 60. Accordingly, the clips 50 perform a dual function of stabilizing the panels and securing the ceiling trim member 60. Trim gaskets 62 are provided to improve sound attenuation.

The ceiling trim member 60 may be an aluminum extrusion which provides an esthetically pleasing appearance and hides parts of ceiling retaining assembly 14.

Referring to FIGS. 2-4 and 6, the floor leveling assembly 16 includes a preferably U-shaped elongate floor channel 74 which is preferably secured to the floor 75 by fasteners 76 located at predetermined intervals. A floor rail 78 is disposed within the floor channel 74. Preferably, the floor rail 78 is an elongate tube having a rectangular cross section. A number of holes are provided in the top and bottom surfaces of the floor rail 78, as described in more detail below.

The floor rail 78 is supported by levelers 80 positioned at intervals along the floor channel 74. Each leveler 80 includes a base 82 which rests on the floor channel 74. A threaded rod 84 projects upwardly from the base 82. An axial opening 85 (shown in FIG. 6) is provided in threaded rod 84 to permit turning of the threaded rod by an Allen key or the like.

Nuts 86 are located in openings of the bottom surface of the floor rail 78. The nuts have a circumferential outer groove 88 which engages the edges of the opening in floor rail 78 to fixedly secure the nuts 86 to floor rail 78. The threaded inner surface of nut 86 engages the threaded rod 84, which rotates to adjust the vertical distance between the floor channel 74 and the floor rail 78.

Figure 8:
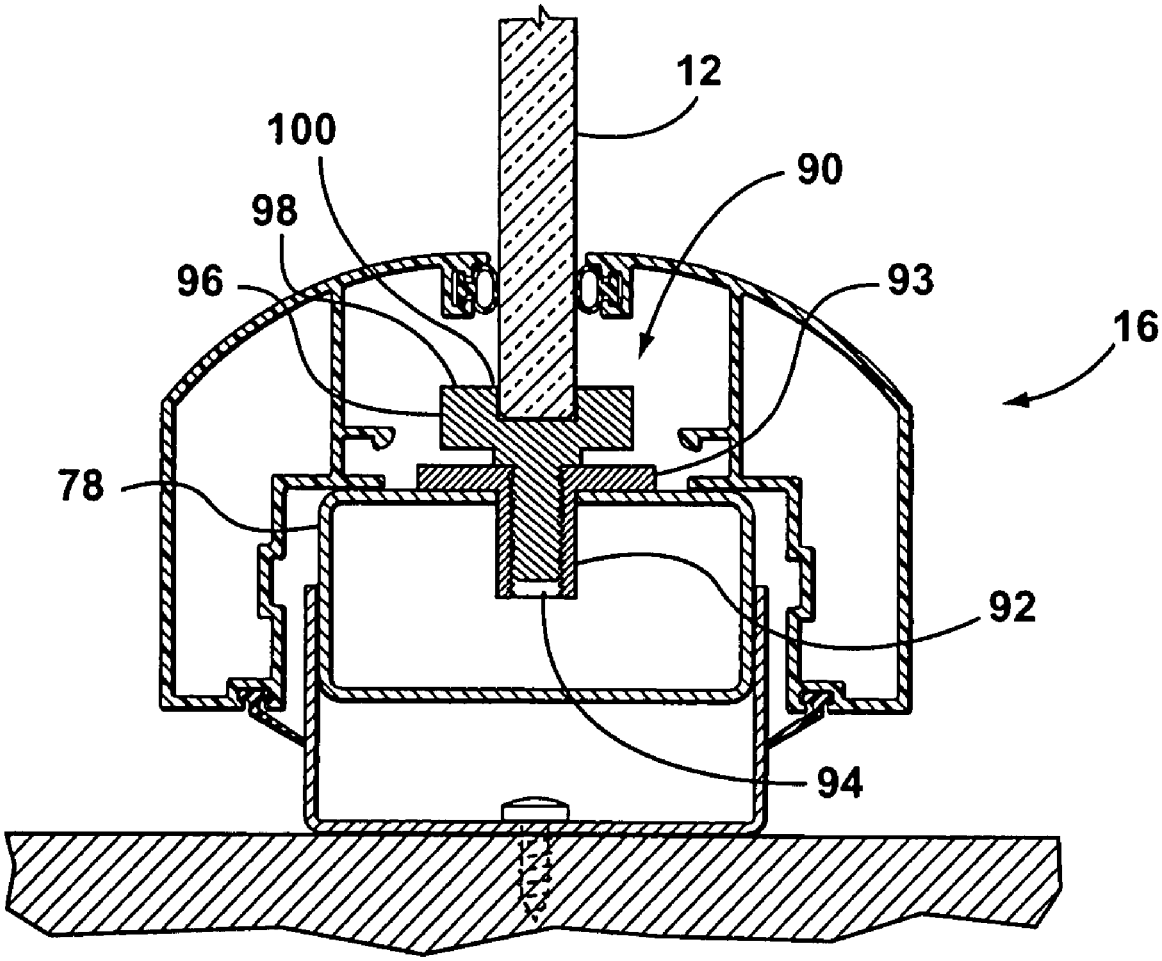
FIG. 8 is a cross-sectional view of the floor leveling assembly along line 8-8 of FIG. 3.

Referring to FIGS. 2, 3, and 8, panel supports 90 are mounted on the top surface of the floor rail 78. Each panel support 90 includes a housing 92 located within an opening in the top surface of the floor rail 78. The housing 92 includes a preferably hexagonal-shaped flange 93 which can be turned with a wrench (not shown) or the like. The flange 93 of housing 92 sits on top of the floor rail 78 and is capable of rotating relative to floor rail 78. A threaded opening 94 is provided in the housing 92 which receives a bolt 96. The bolt 96 includes a hat 98 with a channel 100 which engages the bottom edge of the glass panel 12. The panel supports 90 are capable of providing a fine leveling adjustment for the panels 12, as described in more detail below.

Referring to FIGS. 2-4 and 6-7, elbow brackets 40 and clips 50 are also provided in the floor leveling assembly 16 and are secured to the floor rail 78 in a similar fashion as described for the ceiling retaining assembly 14. A floor trim member 110 snaps into the clips 50 connected to the floor rail 78. Like the ceiling trim member 60, the floor trim member 110 is preferably an aluminum extrusion which hides the floor leveling assembly 16 and provides an esthetically pleasing appearance.

Referring to FIG. 4, trim gaskets 62 are also provided between the floor trim member 110 and the panels 12. A floor gasket 112 is secured to the bottom of the floor trim member 110 and extends between the floor trim member and the floor channel 74. The floor gasket 112 also provides improved sound attenuation.

Figure 9:
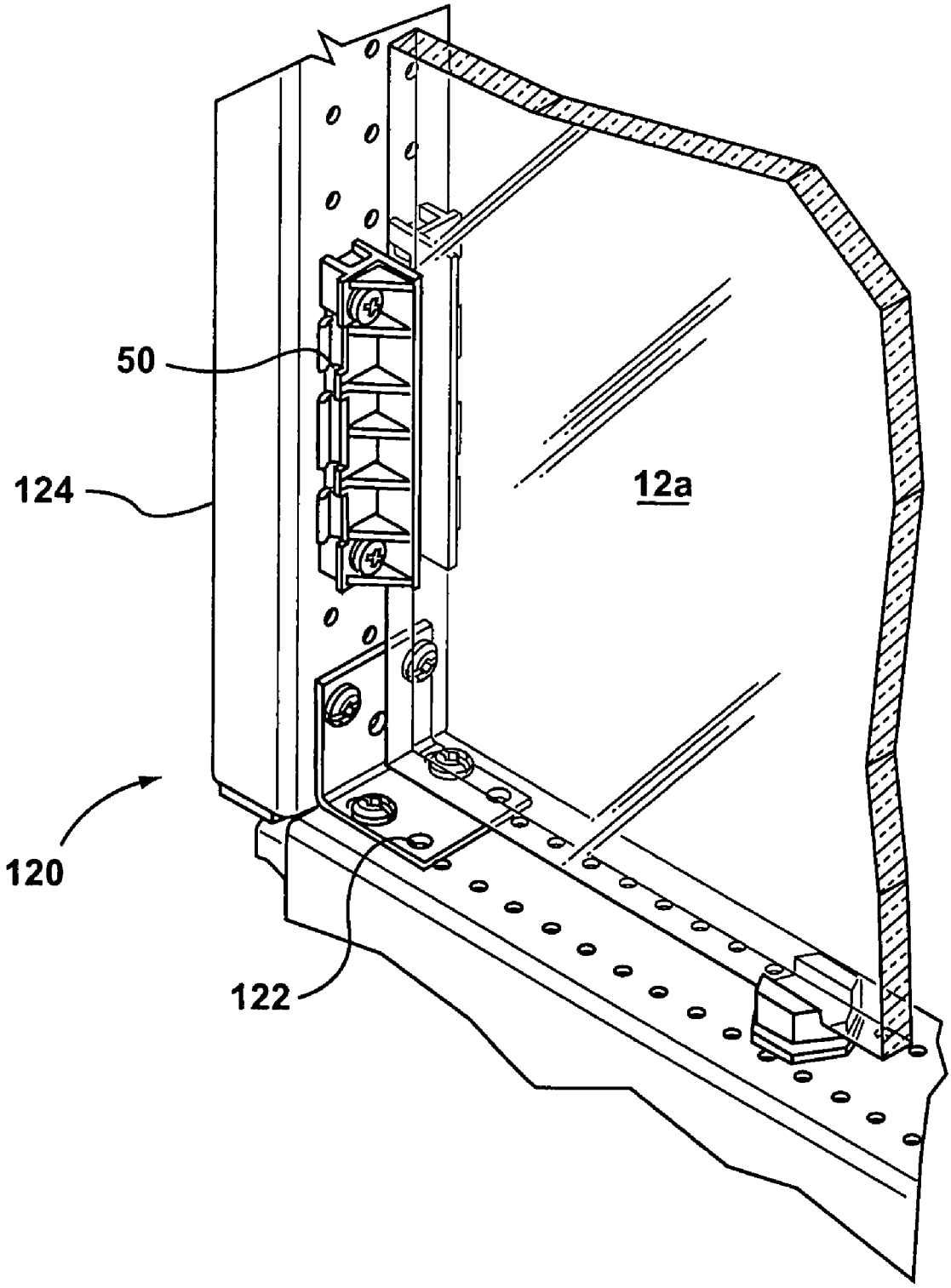
FIG. 9 is a partial perspective view of the corner of the glass wall according to a preferred embodiment of the present invention.

FIG. 9 shows a corner assembly 120, which includes a corner bracket 122 which secures the floor rail 78 to a vertical frame member 124. The vertical frame member 124 may also include the clips 50 to stabilize the vertical edges of the panel 12*a* and to permit snapping connection to a trim member (not shown in FIG. 9).

The operation of the first embodiment of the invention will now be described with reference to FIGS. 1-8.

Referring to FIG. 4, the ceiling retaining assembly 14 and the floor leveling assembly 16 are secured to their desired locations in the ceiling 26 and floor 75, respectively. The ceiling channel 24 is secured to ceiling 26 by fasteners 28. The ceiling rail 32 is then secured to the ceiling channel 24 in the same manner.

Figure 5:
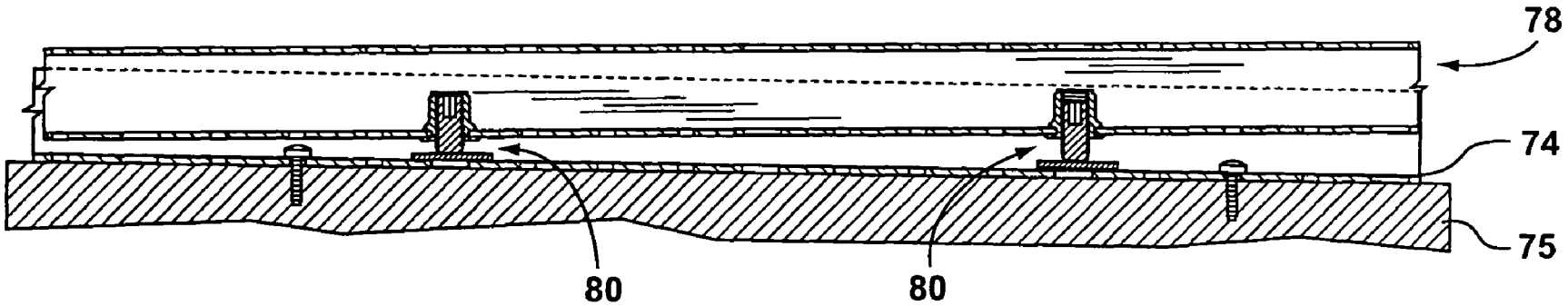
FIG. 5 is a lengthwise cross-sectional view of the floor leveling assembly of the preferred embodiment.
Figure 6:
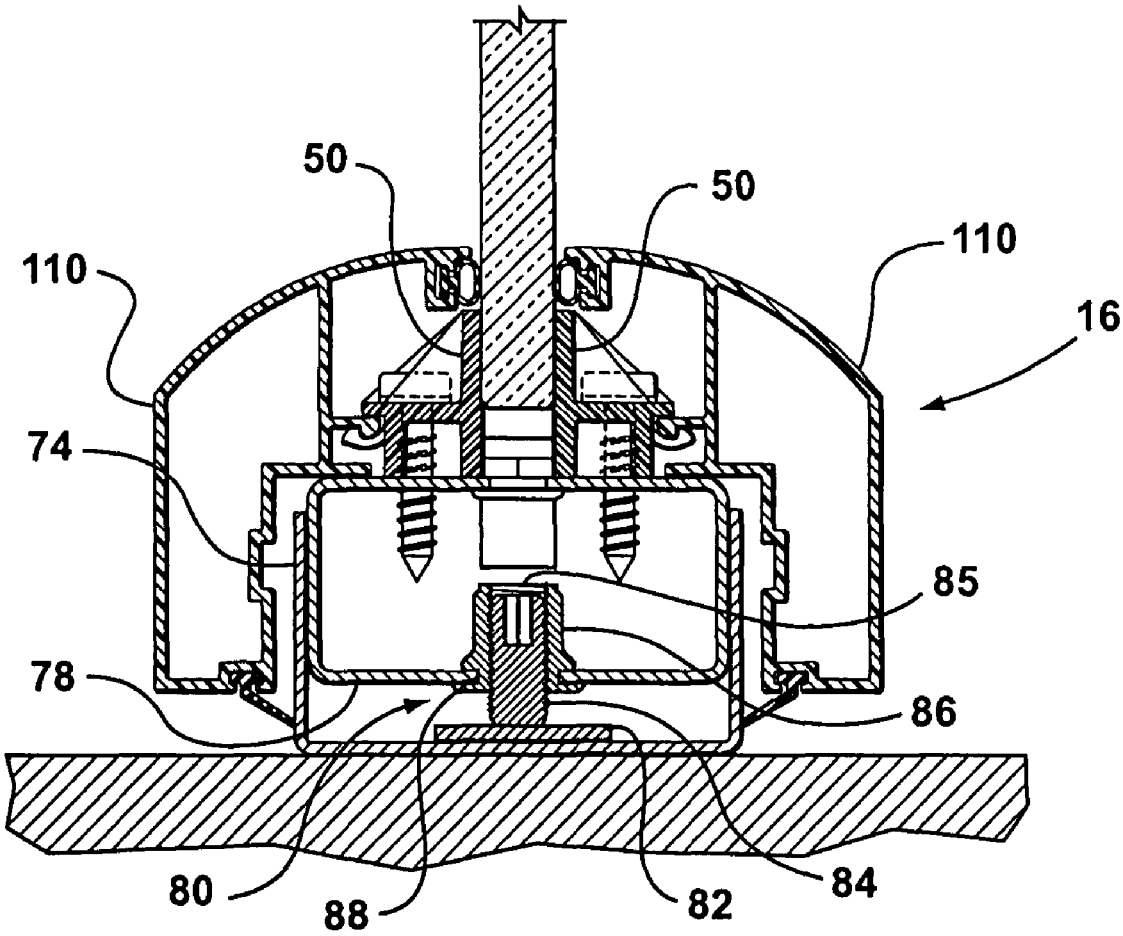
FIG. 6 is a cross-sectional view of the floor leveling assembly along line 6-6 of FIG. 3.
Figure 7:
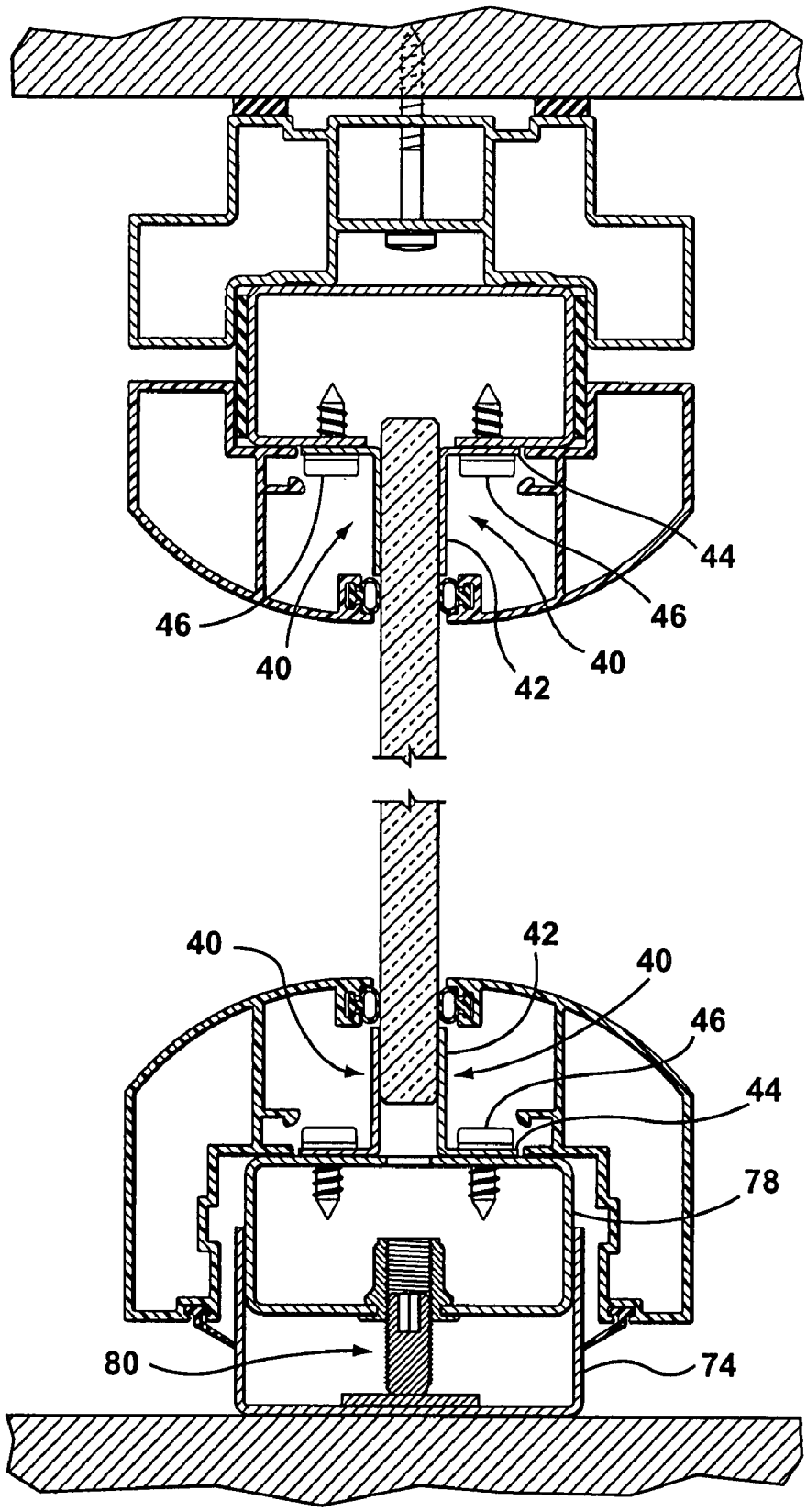
FIG. 7 is a cross-sectional view of the ceiling retaining assembly and the floor leveling assembly along line 7-7 of FIG. 3.

The floor channel 74 is secured to the floor 75 by fasteners 76. The levelers 80 are then located at intervals along the floor channel 74 such that that the threaded rod is aligned with the position of the corresponding nut 86 located in the floor rail 78. The floor rail 78 is then placed within the floor channel 74, and the vertical distance between the floor rail 78 and floor channel 74 is adjusted by turning the threaded rod 84 in nuts 86 using an Allen key (not shown). The floor rail 78 is adjusted such that it is level to the horizontal. Any suitable means, such as a conventional bubble or laser level may be used to guide the leveling of the floor rail 78. An exemplary position of the floor rail 78 relative to floor channel 74 is illustrated in FIG. 5.

Referring to FIGS. 4 and 8, the panels 12*a-c* are then lifted into the slot 34 of ceiling rail 32 and then dropped onto panel supports 90. In particular, the panels 12*a-c* are fitted in channel 100 of hat 98. If necessary, fine leveling adjustment may be provided by turning the flange 93 with a wrench, which in turn, adjusts the height of the bolt 96.

Referring now to FIGS. 2 and 3, each panel 12*a-c* is further secured by mounting the clips 50 in both the ceiling and floor assemblies 14, 16, respectively. As additional panels are installed in the same manner as described above, elbow brackets 40 are mounted to the ceiling and floor assemblies 14, 16 at the joint of adjacent panels. Also, the adhesive material 18 is applied along the adjacent vertical edges of the panels. Finally, the ceiling trim member 60 and floor trim member 110 are snapped onto the clips 50.

Figure 10:
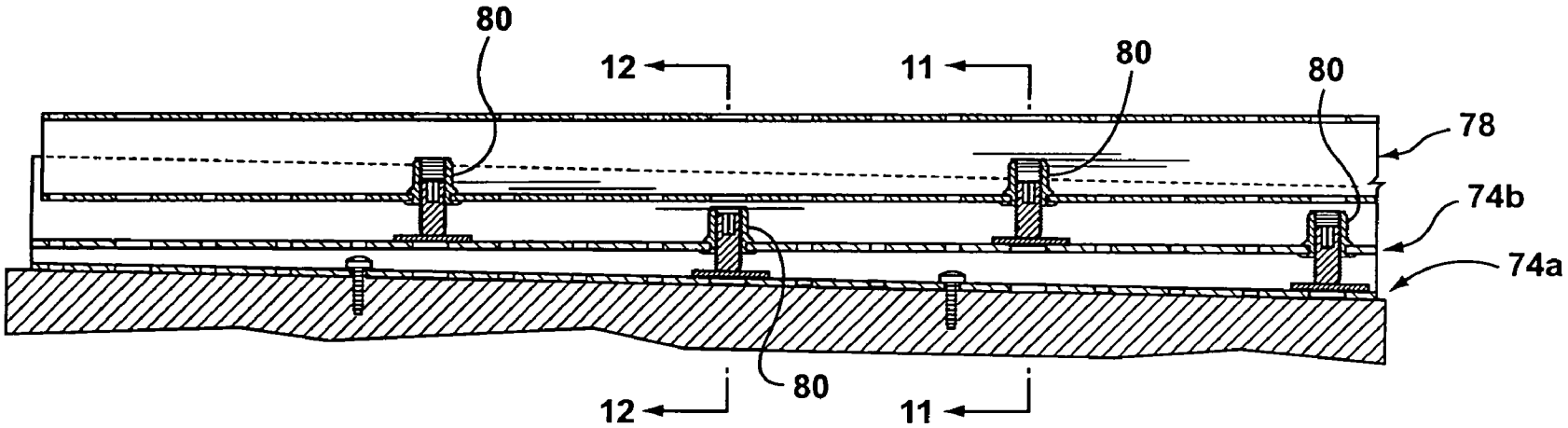
FIG. 10 is a lengthwise cross-sectional view of the floor leveling assembly according to a second embodiment.
Figure 11:
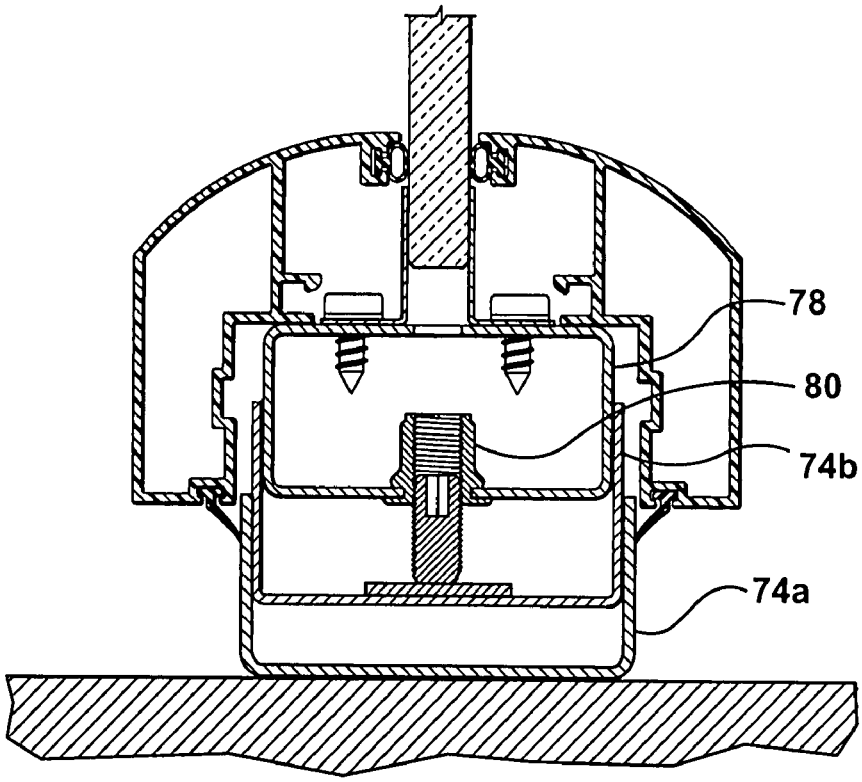
FIG. 11 is a cross-sectional view of the floor leveling assembly along line 11-11 of FIG. 10.
Figure 12:
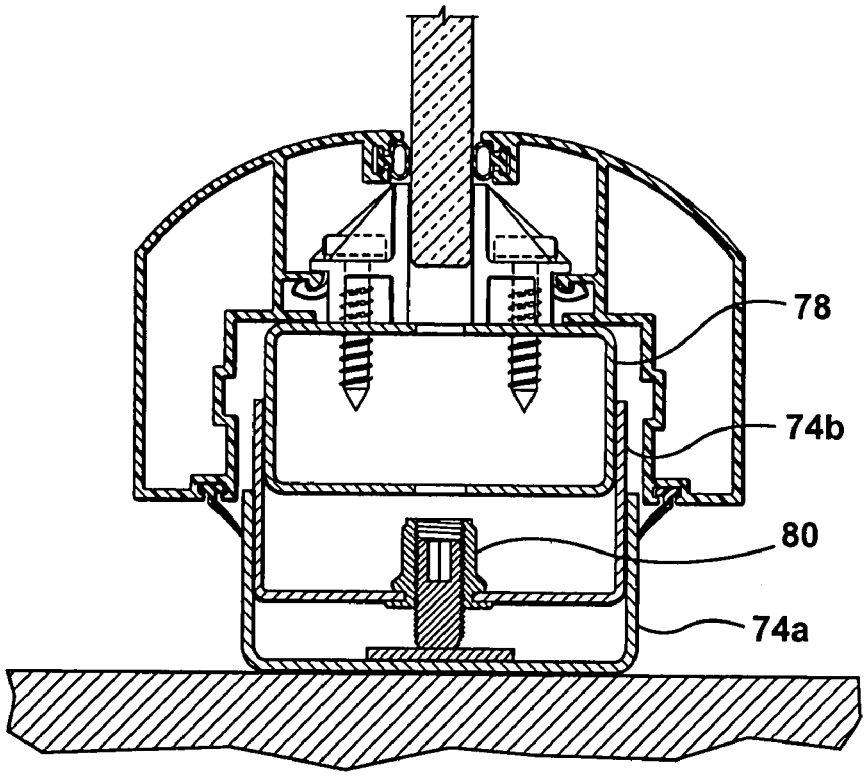
FIG. 12 is a cross-sectional view of the floor leveling assembly along line 12-12 of FIG. 10.

FIGS. 10-12 show a second embodiment of the present invention, which is particularly suited for floor surfaces with greater slope, such that greater leveling is required. In this second embodiment, two or more nested floor channels may be provided. For clarity, only two floor channels 74*a*, 74*b* are illustrated. The uppermost floor channel 74*b* supports the floor rail 78. Levelers 80 are provided between the floor channels 74*a*, 74*b*, and between the uppermost floor channel 74*b* and floor rail 78. In other respects, the second embodiment is similar to the first embodiment.

While the present invention as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims.

The invention claimed is:

1. A leveling assembly for an interior wall system having a plurality of wall panels, the interior wall system configured for installation in a building having a ceiling and a floor, the assembly comprising:

a) at least one elongate floor channel operatively secured to the floor;

b) a floor rail longitudinally disposed within the at least one floor channel, the floor rail comprising a top surface and a bottom surface, wherein the floor rail is adapted to support at least one of the plurality of wall panels; and c) a plurality of levelers positioned along the at least one floor channel, each of the plurality of levelers comprising a base, wherein the base of each of the plurality of levelers is located under the bottom surface of the floor rail, wherein the plurality of levelers are adapted to vertically space apart the floor rail from the at least one floor channel, wherein the plurality of levelers are adapted to substantially level the floor rail in relation to the floor.

2. The leveling assembly of claim 1, wherein the plurality of levelers are adapted to vary the vertical distance between the floor rail and the at least one floor channel in order to substantially level the floor rail in relation to the floor.

3. The leveling assembly of claim 2, wherein at least one of the plurality of levelers further comprises:

a) a threaded rod projecting upwardly from the base; and b) a threaded nut secured to an opening defined in a bottom surface of the floor rail, wherein the threaded nut is adapted to threadably engage the threaded rod.

4. The leveling assembly of claim 3, wherein a hex-shaped axial opening is defined in the distal end of the threaded rod, the hex-shaped axial opening is adapted to be engaged by an Allen key.

5. The leveling assembly of claim 2, wherein the at least one floor channel comprises a plurality of nested floor channels, wherein a portion of the plurality of levelers are located between vertically adjacent floor channels.

6. The leveling assembly of claim 5, wherein the plurality of floor channels comprise a lower floor channel and an upper floor channel, wherein the lower floor channel is secured to the floor and the floor rail is disposed within the upper floor channel.

7. The leveling assembly of claim 2, further comprising a plurality of panel supports connected to a top surface of the floor rail, wherein the panel supports are adapted to provide a fine leveling adjustment for the wall panels.

8. The leveling assembly of claim 7, wherein at least one of the plurality of panel supports comprises:

a) a housing rotatably mounted in an opening defined in a top surface of the floor rail, the housing having a threaded opening defined therein, the housing having a flange adapted to rest on the top surface; and b) a bolt adapted to threadably engage the threaded opening, the bolt having a hat, the hat defining a channel adapted to receive a bottom edge of the of one of the plurality of wall panels;

wherein the flange is rotatable to adjust the height of the bottom edge in relation to the top surface of the floor rail.

9. The leveling assembly of claim 2, wherein the floor channel is U-shaped.

10. The leveling assembly of claim 9, wherein the floor rail comprises an elongate tube having a generally rectangular cross-section.

11. The leveling assembly of claim 2, further comprising at least one clip connected to the floor rail, the clip comprising a wall adapted to abut against the wall panel.

12. The leveling assembly of claim 11, wherein the at least one clip comprises a plurality of clips arranged in pairs positioned in opposed relation to each other, wherein each pair of clips is adapted to receive the wall panel therebetween.

13. The leveling assembly of claim 12, further comprising a floor trim member adapted for connection to the at least one clip.

14. The leveling assembly of claim 13, wherein the floor trim member comprises a longitudinally extending ridge along the interior surface thereof, wherein the at least one clip comprises a shoulder and a resilient retaining member, wherein the ridge and the retaining member define an aperture, wherein the ridge is adapted to snap into the aperture, thereby removably securing the floor trim member to the clip.

15. The leveling assembly of claim 14, wherein the at least one clip comprises a plurality of ribs extending from a vertical portion of the at least one clip.

16. The leveling assembly of claim 15, wherein the vertical portion of the at least one clip is adapted to contact the wall panel in order to stabilize the wall panel without bearing the weight of the wall panel.

17. The leveling assembly of claim 16, further comprising at least one elbow bracket secured to the floor rail, the elbow bracket being located at a joint of adjacent wall panels, wherein the elbow bracket comprises a vertical portion adapted to abut against the adjacent wall panels.

18. A leveling assembly for an interior wall system having a plurality of wall panels, the interior wall system configured for installation in a building having a ceiling and a floor, the assembly comprising:

a) at least one elongate floor channel operatively secured to the floor;

b) a floor rail longitudinally disposed within the at least one floor channel, wherein the floor rail is adapted to support at least one of the plurality of wall panels; and c) a plurality of levelers positioned along the at least one floor channel, wherein the plurality of levelers are adapted to vertically space apart the floor rail from the at least one floor channel, wherein the plurality of levelers are adapted to level the floor rail in relation to the floor; and d) a plurality of panel supports connected to a top surface of the floor rail, wherein the panel supports are adapted to provide a fine leveling adjustment for the wall panels.

19. The leveling assembly of claim 18, wherein at least one of the plurality of panel supports comprises:

a) a housing rotatably mounted in an opening defined in a top surface of the floor rail, the housing having a threaded opening defined therein, the housing having a flange adapted to rest on the top surface; and b) a bolt adapted to threadably engage the threaded opening, the bolt having a hat, the hat defining a channel adapted to receive a bottom edge of the of one of the plurality of wall panels;

wherein the flange is rotatable to adjust the height of the bottom edge in relation to the top surface of the floor rail.

20. A leveling assembly for an interior wall system having a plurality of wall panels, the interior wall system configured for installation in a building having a ceiling and a floor, the assembly comprising:

a) at least one elongate floor channel operatively secured to the floor;

b) a floor rail longitudinally disposed within the at least one floor channel, wherein the floor rail is adapted to support at least one of the plurality of wall panels; and c) a plurality of levelers positioned along the at least one floor channel, wherein the plurality of levelers are adapted to vertically space apart the floor rail from the at least one floor channel, wherein the plurality of levelers are adapted to level the floor rail in relation to the floor; and d) at least one elbow bracket secured to the floor rail, the elbow bracket being located at a joint of adjacent wall panels, wherein the elbow bracket comprises a vertical portion adapted to abut against the adjacent wall panels.

* * * * *